US005230617A

United States Patent [19]

Klein et al.

[11] Patent Number: 5,230,617

[45] Date of Patent: Jul. 27, 1993

[54] FURNACE SHELL COOLING SYSTEM

[76] Inventors: Ernst G. Klein, 300 Bulford Rd., Shavertown, Pa. 18708; Kerry A. Seitz, R.D. #3, Box 360A, Danville, Pa. 17821

[21] Appl. No.: 765,335

[22] Filed: Sep. 25, 1991

[51] Int. Cl.[5] ..... F27D 1/12

[52] U.S. Cl. ..... 432/233; 432/116; 432/238; 110/180

[58] Field of Search ..... 432/233, 238, 237, 116; 110/180, 182

[56] References Cited

U.S. PATENT DOCUMENTS

| | | | |
|---|---|---|---|
| 2,119,322 | 5/1938 | Ewing | 110/182 |
| 2,531,344 | 11/1950 | Polad | 110/180 |
| 2,532,322 | 12/1950 | McFarlin . | |
| 3,149,615 | 9/1964 | Forsans . | |
| 3,368,545 | 2/1968 | Ibbitson | 110/180 |
| 3,511,643 | 5/1970 | Vallak et al. . | |
| 3,700,217 | 10/1972 | Rauskolb . | |
| 3,752,638 | 8/1973 | Van Laar et al. . | |
| 4,046,548 | 9/1977 | Wood et al. . | |
| 4,137,038 | 1/1979 | Vorobeichikov et al. | 432/116 |
| 4,199,652 | 4/1980 | Longenecker | 432/238 |
| 4,206,312 | 6/1980 | Kuhlmann . | |
| 4,288,214 | 9/1981 | Harman | 432/233 |
| 4,422,436 | 12/1983 | Chamberlain | 110/180 |
| 4,570,550 | 2/1986 | Wilt . | |
| 4,973,245 | 11/1990 | Monni | 432/116 |

*Primary Examiner*—Henry C. Yuen

*Attorney, Agent, or Firm*—Caesar, Rivise, Bernstein, Cohen & Pokotilow, Ltd.

[57] ABSTRACT

A system for cooling a single or plural zones of the exterior of a furnace or similar hot device, e.g., kiln, calciner, etc. Each zone is cooled by a respective cooling assembly. The operation of the assemblies is effected by a common control system. Each cooling assembly comprises a shroud, an induction cooler, e.g., an exhaust fan, and at least one atomizing spray nozzle. The shroud is in the form of a jacket disposed over the associated exterior zone of the furnace and is spaced therefrom to form a cooling chamber therebetween. The exhaust fan is coupled to the shroud for inducing the flow of cooling air through the cooling chamber so that it absorbs heat from furnace's exterior. The atomizing spray nozzle is also coupled to the shroud and to a water and an air supply for introducing atomized droplets of water into the chamber, whereupon the droplets vaporize to absorb heat from the furnace's exterior. The exhaust fan vents the air and steam from the shroud means. A controller controls the operation of each cooling assembly pursuant to feed-back signals from respective thermal sensors mounted in each cooling assembly.

30 Claims, 2 Drawing Sheets

LIQUID SUPPLY
GAS SUPPLY
LIQUID SUPPLY
GAS SUPPLY 40
44
50
46
52
48
24C
22A
22
32
36
34
24
54
56
58
60

FURNACE SHELL COOLING SYSTEM

BACKGROUND OF THE INVENTION

This invention generally relates to furnaces and more particularly to cooling systems therefore.

Air-cooling or water cooling of the walls or shell of an industrial furnace is an almost universally accepted technique and is used in furnaces of all types, e.g., stationary, rotary, etc., capacities and for all types of fuel and methods of firing. Thus, one common practice is to cool the walls or shell of an industrial furnace via the use a plurality of external fans focused thereon. This technique has its drawbacks, e.g., complexity, inefficiency, non-uniformity of air flow, fan noise, etc. Another type of air cooling involves the induction of air about the furnace shell. In particular with this technique a sheet metal hood is provided about the furnace and an exhaust fan coupled to the hood to pull cooling air into the area between the hood and the furnace shell. In order to maximize the cooling effects large amounts of air are required, thereby necessitating a large fan. Moreover, this technique still leaves much to be desired from the standpoints of efficiency and uniformity of the air flow within the hood/shell.

Water-cooling of furnaces walls has been used and is generally more effective than air cooling techniques. The water cooling of the furnace wall reduces the mean temperature of the structural members and, consequently, their temperatures are kept within the limits that provide satisfactory strength and resistance to oxidation, while reducing heat transfer to the furnace surroundings. Water-cooled tube constructions facilitate large furnace dimensions and optimum arrangements of the furnace roof, hopper, and arch, as well as the mountings for the burners and the provision for screens, platens, or division walls to increase the amount of heat-absorbing surface exposed in the combustion zone. External heat losses are small and are further reduced by the use of insulation.

Prior art methods utilizing water-cooled furnace walls include constructions utilizing water-containing tube constructions surrounding the exterior of the furnace shell and are commonly referred to as the tangent tube, welded membrane and tube, flat stud and tube, full stud and refractory-covered tube and the tube and tile-type construction. T. Baumeister, Marks' Standard Handbook for Mechanical Engineers, 7th Ed., McGraw-Hill (1967).

Other prior art methods of cooling an industrial-type furnace with water include the use of multiple spigots or spray lances which spray water on the exterior of the furnace shell from above. The water vaporizes as it hits the furnace shell and any water which does not vaporize upon contact runs down the sides of the shell where it may vaporize. The water's evaporation reduces the shell temperature. This method of shell cooling, while generally better than air cooling, is never the less somewhat inefficient and suffers from numerous drawbacks and hazards, e.g., non-uniformity of cooling, producing an uncontrolled amount of steam into the environment, causing water to run onto the floor, etc.

Accordingly, a need exists for an efficient furnace shell cooling system to be used in cooling an industrial type furnace.

OBJECTS OF THE INVENTION

It is thus a general object of this invention to provide a furnace shell cooling system which overcomes the disadvantages of the prior art.

It is a further object of this invention to provide a furnace shell cooling system which is efficient in operation.

It is still a further object of this invention to provide a furnace shell cooling system utilizing a combination of induction cooling and evaporation cooling.

It is yet a further object of this invention to provide a furnace shell cooling system which establishes a plurality of cooling zones and/or a uniform temperature over the total shell length.

It is another object of this invention to provide a furnace shell cooling system utilizing a plurality of individually controllable cooling zones and/or uniform temperature zone of the shell in spite of varying temperature conditions inside of the shell.

It is furthermore another object of this invention to increase the availability of a furnace having a refractory lining, due to longer refractory life influenced by lower mean refractory temperature.

SUMMARY OF THE INVENTION

These and other objects of this invention are achieved by providing a system for cooling at least a portion of the exterior, e.g., shell, of a furnace, with that portion defining a first zone. The system comprises a cooling assembly having hood means, gas cooling means, and liquid injector means. The hood means, e.g., a jacket, is disposed over the zone and is spaced from the furnace's shell to form a cooling chamber therebetween. The gas cooling means, e.g., an exhaust fan, is coupled to the hood means for inducing the flow of a cooling gas, e.g., air, through the cooling chamber so that the gas absorbs heat from furnace's shell. The liquid injector means, e.g., an atomizing spray head, is-coupled to the hood means for introducing droplets of a cooling liquid, e.g., water, into the chamber, whereupon the droplets vaporize to absorb heat from the furnace's exterior. The gas cooling means vents the gas and vaporized liquid from the hood means.

In accordance with one preferred aspect of this invention and depending upon the device to be cooled, the system may include one or plural cooling zones, with each zone having a respective cooling assembly associated with it. Moreover, control means are provided for coordinating the operation of the various means making up the cooling assemblies.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENT

Figure 1:
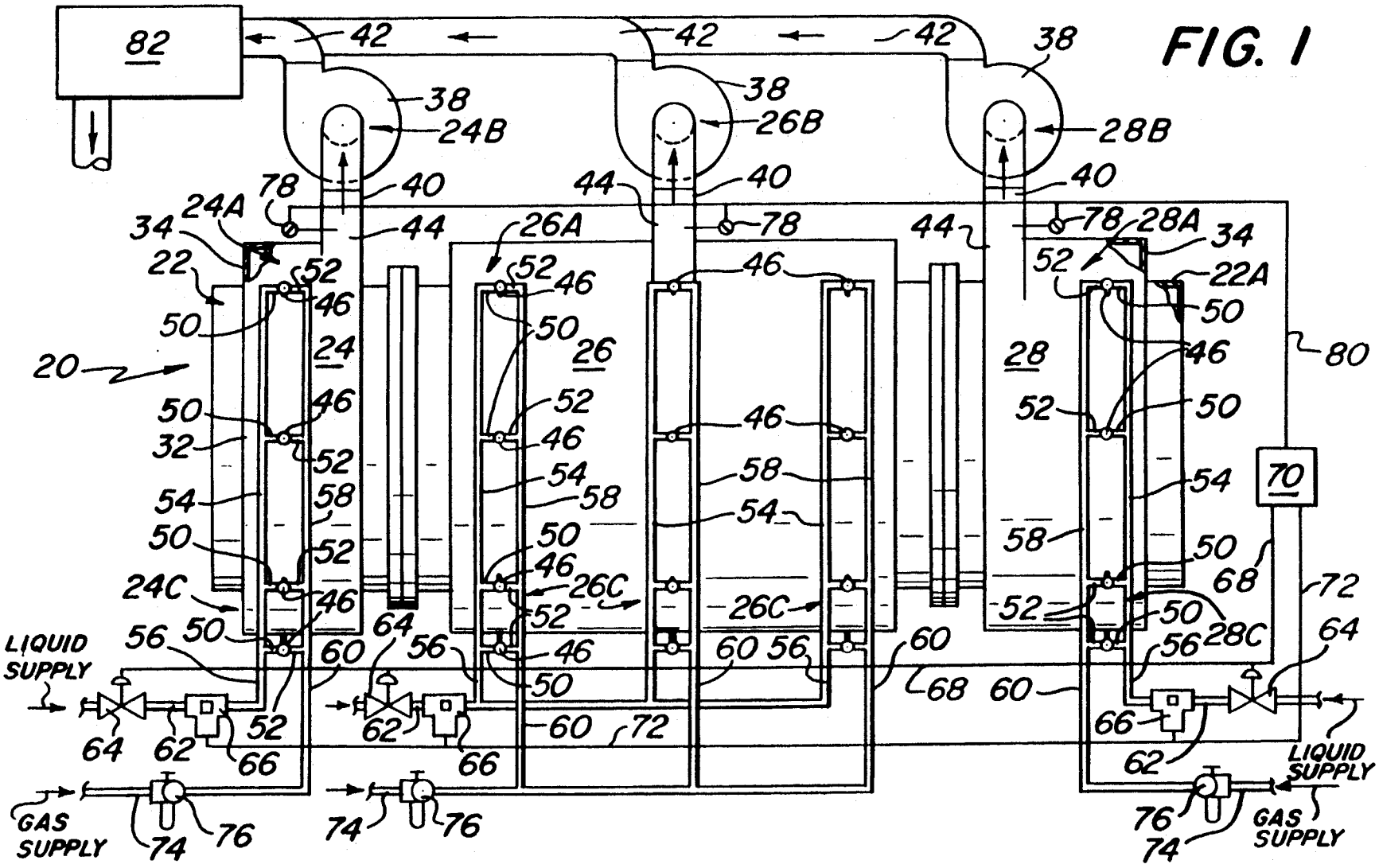
FIG. 1 is a side elevational view, partially schematic, of a furnace shell cooling system constructed in accordance with this invention.

Referring now to various figures of the drawings where like reference numerals refer to like parts, there is shown at 20 in FIG. 1, a system constructed in accordance with this invention for cooling the exterior wall or shell 22A of a conventional furnace 22. The system can be used with various types and shapes of furnaces. In fact, the system can be used to cool or lower the average mean temperature of other similar hot devices, e.g., kilns, calciners, etc. Thus, the cylindrically shaped furnace shown herein is merely exemplary.

The system 20 includes at least one cooling assembly disposed over a predetermined peripheral area (hereinafter called a "zone") of the furnace shell. In the embodiment shown herein three such assemblies, 24, 26 and 28, make up the system 20 to cool three, longitudinally disposed zones of the furnace shell 22A. The operation of each cooling assembly is controlled by means to be described later. That means may comprise a common controller for individually controlling each assembly or may comprises plural controllers, one for each assembly.

Each cooling assembly basically comprises shroud which is designated by the reference character "A" (the shroud for assemblies 24, 26, and 28 being designated as 24A, 26A, and 28A, respectively), an induction gas flow subassembly which is designated by the reference character "B" (the gas flow subassembly for cooling assemblies 24, 26, and 28 being designated as 24B, 26B, and 28B, respectively), and a liquid injecting subassembly which is designated by the reference character "C" (the liquid injecting subassembly for cooling assemblies 24, 26, and 28 being designated as 24C, 26C, and 28C, respectively).

Each shroud is constructed in a similar manner to the others, except that in the exemplary embodiment of the invention shown herein the shroud 26 is considerably wider than the shrouds 24 and 28 to create a wider cooling zone in the middle of the furnace than at its ends. Depending upon the type and shape of the hot device (e.g., kiln, furnace, etc.) only one cooling zone need be designed.

Figure 2:
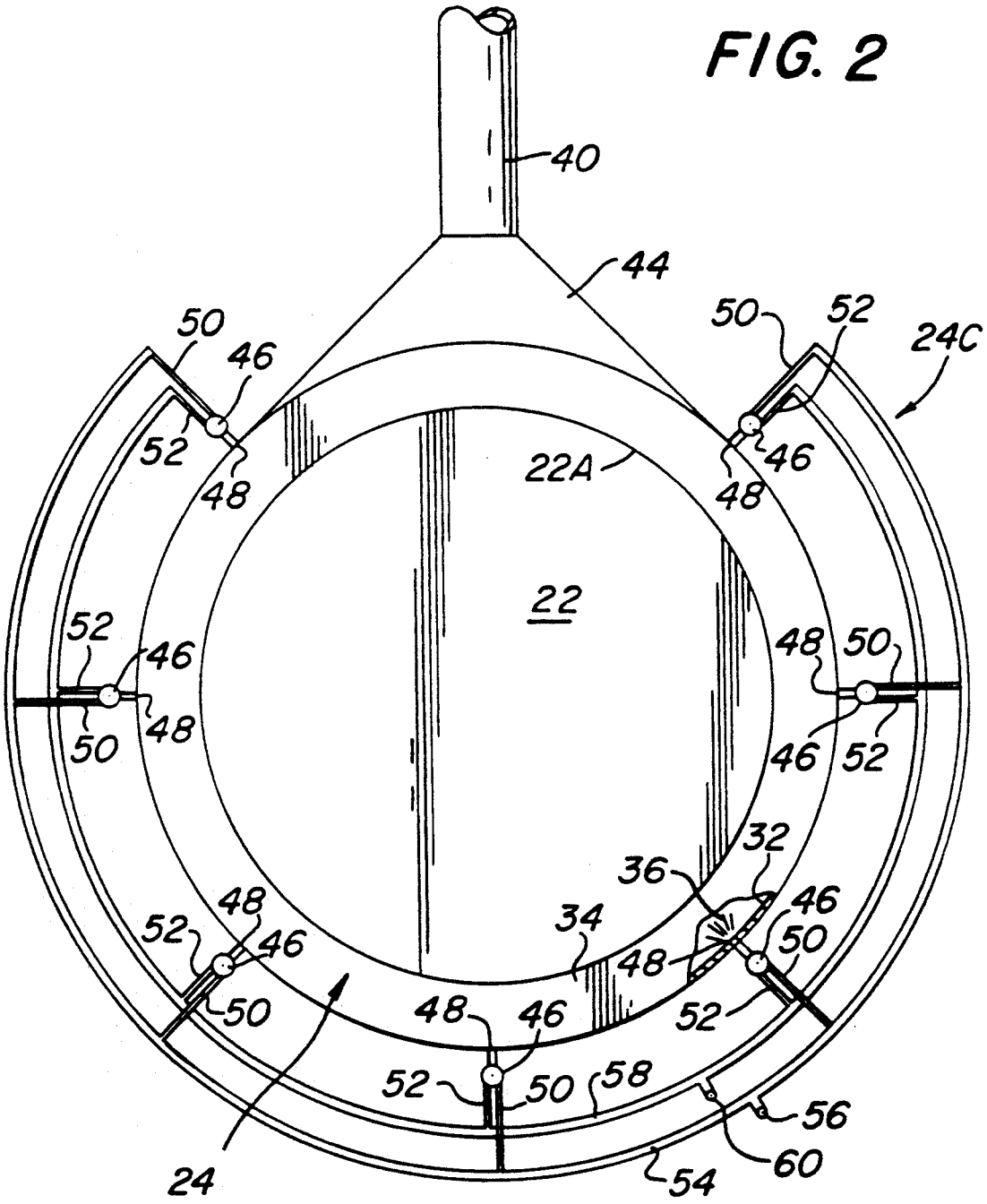
FIG. 2 is an end view, partially in section, of the furnace shell cooling system shown in FIG. 1.

In the interests of brevity only the left most shroud 24A will be described. Thus, as can be seen in FIGS. 1 and 2 the shroud 24A basically comprises a sheet 32 of any suitable material, e.g., steel, in a shape, e.g., cylindrical, generally conforming to the contour of the furnace shell over which it is disposed and is spaced a predetermined distance therefrom. The sheet 32 has a pair of marginal side walls 34 extending close to the surface of the furnace shell. Thus, the sheet 32 and its marginal side walls 34 form a hollow jacket enclosing a cooling chamber 36 (FIG. 2) between it and the portion of the furnace shell making up that cooling zone.

Each of the induction gas flow subassemblies 24B, 26B, and 28B is constructed in a similar manner to the others and is connected to a respective shroud, e.g., 24A, for inducing the flow of a cooling gas, e.g., air, through the shroud's cooling chamber 36 to absorb heat from the underlying portion of the shell. Moreover as will be described later each of the liquid injecting subassemblies 24C, 26C, and 28C, is mounted with respect to a respective shroud to inject an atomized cooling liquid, e.g., water, into the cooling chamber, so that the injected liquid immediately vaporizes, thereby removing heat from that chamber. The vapor produced by the evaporation of the injected liquid droplets is carried from the shroud by the induction gas flow subassembly associated with that shroud, as will also be described later.

As can be seen in FIGS. 1 and 2 each of the induction gas flow subassemblies 24B, 26B, and 28B basically comprises an electrically operated exhaust fan 38, an inlet conduit 40, an outlet duct 42, and a flared hood 44. The hood 44 is mounted on the top portion of the associated shroud and is in fluid communication with the chamber 36 therein. The top end of the hood 44 terminates in the end of the inlet conduit 40 and is in fluid communication therewith. The inlet conduit is connected to the inlet of the exhaust fan 38. The outlet of the fan 38 is connected to the outlet duct 42. Each outlet duct is in fluid communication with a heat exchanger (to be described later).

Each of the liquid injecting subassemblies 24C, 26C, and 28C is constructed in a similar manner to the others, with one such subassembly mounted on each of the end shrouds 24A and 28A, but with three such subassemblies mounted on the middle shroud 26 (inasmuch as the shroud 26 is considerably wider than the shrouds 24 and 28). As can be clearly seen in FIG. 2 each of the liquid injecting subassemblies basically comprises a plurality of atomizing nozzles 46 mounted on the outside surface of the sheet 32 making up the associated shroud. Each nozzle is of conventional construction and is of the dual fluid type, e.g., is arranged to receive a liquid, e.g., water, and a compressed gas, e.g., air, to mix them and create an aerosol of very fine liquid droplets. The nozzles each include an outlet port 48 extending through the top sheet 32 of the shroud to effect the injection of the aerosol into the shroud's cooling chamber.

As should be appreciated by those skilled in the art the vaporization of the liquid will absorb heat from the furnace shell to a much greater degree than could be accomplished by merely circulating air through the cooling chamber or by merely proving water through water tubes or a water cooled jacket.

In order to produce the atomized liquid droplets each nozzle also includes a first input line 50 for receiving the cooling liquid, e.g., water, and a second input line 52 for receiving the compressed gas, e.g., air. The input lines 50 of each of the nozzles 46 associated with each shroud are connected to a common feed conduit 54. The feed conduit is connected to a header line 56 for conveying the liquid from a supply (to be described later) to the lines 50. In a similar manner the input lines 52 of each of the nozzles 46 associated with each shroud are connected to a common feed conduit 58. The feed conduit 58 is connected to a header line 60 for conveying the gas from a supply (to be described later) to the lines 52.

In accordance with one preferred embodiment of this invention the nozzles are of the type sold by Bete Fog Nozzle, Inc. of Greenfield, Mass. Similar devices of other manufacturers may, of course, be utilized.

The cooling liquid is provided from a supply (not shown) to each of the cooling assemblies via a respective conduit 62, a flow control valve 64, and a flow indicator 66. Each flow control valve 64 is a conventional modulating device arranged to receive electrical control signals to establish the liquid flow rate (e.g., gallons/minute) therethrough. The electrical control signals are provided to the valves 64 via respective control lines 68 from a controller 70 so that the flow rate of liquid to each cooling assembly may be individually adjusted or controlled to expedite the cooling of the furnace. Each flow rate indicator 66 is a conventional device which is arranged to provide an electrical signal output indicative of the rate of flow of the liquid therethrough. The electrical signals from each flow rate indicator 66 are provided via respective control lines 72 to the controller 70.

The controller 70 is any conventional device, e.g., a microprocessor, arranged to receive and provide the control signals for operating the system 20.

The cooling gas is provided from a supply (not shown) to each of the cooling assemblies via a respective conduit 74 and pressure regulating filter 76. Each pressure regulating filter is a conventional device arranged to manually establish and maintain the a desired pressure, e.g., between 80 and 100 psi or higher, of the gas flowing therethrough, while also filtering out or otherwise trapping any debris. Each filter 76 is connected in the conduit 74 upstream of the gas header 60 of each cooling assembly.

In accordance with a preferred embodiment of this invention each of the cooling zones established by the cooling system 20 is individually monitored for individual temperature control. To that end each cooling assembly includes its own temperature sensor 78 which is mounted in the hood 44 of the associated shroud. Each temperature sensor is a conventional device which is arranged to provide an electrical signal representative of the temperature within the shroud via an associated line 80 to the controller 70. The controller 70 uses this signal to effect the control of the cooling assembly for that zone.

As should be appreciated by those skilled in the art, the foregoing temperature feedback feature enables each zone to be cooled according to its own requirements. Moreover, since the system 20 utilizes a closed loop feedback system to enable the amount of cooling liquid and gas to be varied, the furnace shell can be maintained at a uniform or desired controlled temperature. Further still, if any zone requires cooling, such action can be readily accomplished automatically.

As mentioned earlier, the system 20 includes a heat exchanger. This unit is a conventional device 82 which serves to receive the vaporized liquid, e.g., steam, carried from the cooling assemblies by their respective ducts 42. The heat exchanger 82 is arranged to condense those vapors into liquid for recycling back to the cooling assemblies or for collection by some other means (not shown). The use of the condenser is not mandatory. Thus, the vapors produced by the system 20 can be released to the ambient atmosphere, if appropriate.

As should be appreciated from the foregoing, the subject cooling system offers numerous advantages over the prior art, such as those features discussed heretofore. In addition the system 20 provides a measure of safety to allow operation of the furnace in an emergency situation wherein the air cooling fan is not operating. In such a case the cooling system can still function to some degree by virtue of the cooling effect of the atomized liquid.

Without further elaboration the foregoing will so fully illustrate our invention that others may, by applying current or future knowledge, adopt the same for use under various conditions of service.

We claim:

1. A system for cooling at least a portion of the shell of a hot device, said portion defining a first zone, said system comprising a cooling assembly comprising hood means, gas cooling means, and liquid injecting means, said hood means being disposed over said zone and spaced from said shell to form a cooling chamber therebetween, said gas cooling means being coupled to said hood means for inducing the flow of cooling gas through said cooling chamber so that said gas absorbs heat from said shell, said liquid injector means being coupled to said hood means for introducing droplets of a cooling liquid into said chamber, whereupon said droplets of cooling liquid vaporize to absorb heat from said shell of said hot device, said gas cooling means venting said gas and vaporized liquid from said hood means.

2. The system of claim 1 additionally comprising control means for controlling the operation of said gas cooling means and said liquid injector means.

3. The system of claim 1 wherein said gas is air and said liquid is water, whereupon said water droplets form steam within said chamber, said air and steam being vented from said chamber by said gas cooling means.

4. The system of claim 1 wherein said liquid injecting means comprises at least one nozzle, with said liquid being provided to said nozzle, said cooling assembly additionally comprising atomizing gas means coupled to said nozzle for supplying an atomizing gas to said nozzle to atomize said liquid into very fine droplets to expedite the vaporization thereof.

5. The system of claim 4 wherein said liquid injecting means additionally comprises flow control valve means and flow indicator means, and wherein said atomizing gas means additionally comprises pressure regulating filter means.

6. The system of claim 2 wherein said liquid injecting means comprises at least one nozzle, with said liquid being provided to said nozzle, said cooling assembly additionally comprising atomizing gas means coupled to said nozzle for supplying an atomizing gas to said nozzle to atomize said liquid into very fine droplets to expedite the vaporization thereof.

7. The system of claim 6 wherein said liquid injecting means additionally comprises flow control valve means and flow indicator means, and wherein said atomizing gas means additionally comprises pressure regulating filter means.

8. The system of claim 3 wherein said liquid injecting means comprises at least one nozzle, with said water being provided to said nozzle, said cooling assembly additionally comprising atomizing gas means coupled to said nozzle for supplying air to said nozzle to atomize said water into very fine droplets to expedite the vaporization thereof.

9. The system of claim 8 wherein said liquid injecting means additionally comprises flow control valve means and flow indicator means, and wherein said atomizing gas means additionally comprises pressure regulating filter means.

10. The system of claim 1 wherein said system is arranged for cooling plural portions of the shell of said hot device, each of said portions defining a respective zone, said system comprising plural cooling assemblies, each of said assemblies being associated with a respective portion of said shell.

11. The system of claim 10 additionally comprising control means for controlling the operation of said gas cooling means and said liquid injector means.

12. The system of claim 10 wherein said gas is air and said liquid is water, whereupon said water droplets form steam within said chamber, said air and steam being vented from said chamber by said gas cooling means.

13. The system of claim 10 wherein said liquid injecting means comprises at least one nozzle, with said liquid being provided to said nozzle, said cooling assembly additionally comprising atomizing gas means coupled to said nozzle for supplying an atomizing gas to said nozzle to atomize said liquid into very fine droplets to expedite the vaporization thereof.

14. The system of claim 13 wherein said liquid injecting means additionally comprises flow control valve means and flow indicator means, and wherein said atomizing gas means additionally comprises pressure regulating filter means.

15. The system of claim 11 wherein said liquid injecting means comprises at least one nozzle, with said liquid being provided to said nozzle, said cooling assembly additionally comprising atomizing gas means coupled to said nozzle for supplying an atomizing gas to said nozzle to atomize said liquid into very fine droplets to expedite the vaporization thereof.

16. The system of claim 15 wherein said liquid injecting means additionally comprises flow control valve means and flow indicator means, and wherein said atomizing gas means additionally comprises pressure regulating filter means.

17. The system of claim 1 wherein said gas cooling means comprises an exhaust fan.

18. The system of claim 10 wherein said gas cooling means comprises an exhaust fan.

19. The system of claim 13 wherein said gas cooling means comprises an exhaust fan.

20. The system of claim 1 additionally comprising condensing heat, exchanger means for collecting and condensing said vaporized liquid.

21. The system of claim 10 additionally comprising condensing heat exchanger means for collecting and condensing said vaporized liquid.

22. The system of claim 13 additionally comprising condensing heat exchanger means for collecting and condensing said vaporized liquid.

23. The system of claim 20 wherein said condensing heat exchanger means is coupled to said liquid injection means to provide said cooling liquid thereto.

24. The system of claim 21 wherein said condensing heat exchanger means is coupled to said liquid injection means to provide said cooling liquid thereto.

25. The system of claim 22 wherein said condensing heat exchanger means is coupled to said liquid injection means to provide said cooling liquid thereto.

26. The system of claim 1 additionally comprising means for sensing the temperature of the gas and vapor venting from said hood means.

27. The system of claim 2 additionally comprising means for sensing the temperature of the gas and vapor venting from said hood means and for providing a signal indicative thereof to said control means.

28. The system of claim 11 additionally comprising means for sensing the temperature of the gas and vapor venting from said hood means and for providing a signal indicative thereof to said control means.

29. The system of claim 16 additionally comprising means for sensing the temperature of the gas and vapor venting from said hood means and for providing a signal indicative thereof to said control means, said flow control valve means being arranged for providing signals to and receiving signals from said control means, and said flow indicator means being arranged for providing signals to and receiving signals from said control means.

30. The system of claim 1 wherein said device is selected from the group comprising furnaces, kilns, calciners, or the like.

* * * * *